United States Patent [19]

Ciuti

[11] 4,310,428

[45] Jan. 12, 1982

[54] LUBRICANTS, AND PROCESS FOR THICKENING ORGANIC LIQUIDS

[75] Inventor: Brunello Ciuti, San Donato Milanese, Italy

[73] Assignee: Snamprogetti, S.p.A., Milan, Italy

[21] Appl. No.: 24,734

[22] Filed: Mar. 28, 1979

Related U.S. Application Data

[63] Continuation of Ser. No. 667,668, Mar. 17, 1976, abandoned.

[30] Foreign Application Priority Data

Mar. 17, 1975 [IT] Italy ..... 21321 A/75
Dec. 11, 1975 [IT] Italy ..... 30191 A/75

[51] Int. Cl.[3] ..... C10M 5/22; C10M 5/02; C10M 7/38; C10M 7/02

[52] U.S. Cl. ..... 252/33

[58] Field of Search ..... 252/33, 33.3

[56] References Cited

U.S. PATENT DOCUMENTS

| | | | |
|---|---|---|---|
| 2,501,731 | 3/1950 | Mertes | 252/33 |
| 2,540,534 | 2/1951 | Kolfenbach et al. | 252/33.2 |
| 2,629,692 | 2/1953 | Liehe | 252/33.2 |
| 2,854,408 | 9/1958 | Brugmann et al. | 252/33 |
| 3,242,079 | 3/1966 | McMillen | 252/33 |
| 3,349,122 | 10/1967 | Segessemann | 252/33 |

*Primary Examiner*—Delbert E. Gantz
*Assistant Examiner*—Irving Vaughn
*Attorney, Agent, or Firm*—Morgan, Finnegan, Pine, Foley & Lee

[57] ABSTRACT

A process for thickening an organic liquid, particularly useful in the manufacturing of lubricant greases, comprises; mixing the liquid with a metal sulphonate and possibly a volatile organic solvent, and then heating and/or grinding the resulting mixture.

6 Claims, No Drawings

LUBRICANTS, AND PROCESS FOR THICKENING ORGANIC LIQUIDS

This is a continuation, of application Ser. No. 667,668 filed Mar. 17, 1976, which is now abandoned.

This invention relates to lubricants, especially a lubricating grease, and to a process for tickening organic liquids using sulphonates of a metal belonging to Group II or III of the periodic Table.

The Periodic Table referred to in the present specification is that appearing on the inside back cover of "Handbook of Chemistry and Physics" 55th Edition (1974–1975), published by CRC Press Inc., of Cleveland, Ohio, United States of America.

In this Periodic Table, Group IIA comprises beryllium, magnesium, calcium, strontium, barium and radium; Group IIIA comprises boron, aluminium, gallium, indium and thallium; Group IIB comprises zinc, cadmium and mercury; and Group IIIB comprises scandium, yttrium, lanthanum and actinium.

According to one aspect of the present invention there is provided a process for thickening an organic liquid, which comprises mixing the organic liquid with a sulphonate of a metal belonging to Group II or III of the Periodic Table (hereinbefore referred to), and subjecting the resulting mixture to heating and/or grinding.

Preferably the sulphonate is present in the mixture in an amount of from 0.5 to 40% by weight of the combined weight of sulphonate and organic liquid.

In one embodiment of the process of the present invention the sulphonate and/or the organic liquid is/are heated in the presence of a volatile organic solvent which is subsequently removed prior to the grinding.

Preferably, for reasons explained below, there is also mixed with the organic liquid and sulphonate an oxide of the same metal as that present in the sulphonate.

The organic liquids which can be thickened by the process of the present invention can be, for example, substances having viscosity, creep and volatility values ranging from those typical of organic solvents to those typical of lubricating liquids. For instance, the organic liquids may be selected from acyclic aliphatic and cyclic alcohols, ketones, aromatic or aliphatic hydrocarbons, chlorinated aromatic hydrocarbons and silicones; the process can be practiced by starting from those compounds as such or from mixtures of these compounds.

As far as the metal sulphonates are concerned, they are generally metal aliphatic sulphonates, usually alkyl monosulphonates, alkylene disulphonates or hydroxyalkyl monosulphonates. The sulphonates are desirably from suitable oil olefinic cuts, preferably from $C_{12}$–$C_{24}$ cuts. Preferably use is made of the mono alpha-olefins having different molecular weights which, after having been subjected to sulphonation and converted to the sodium or ammonium salt, are then converted to the corresponding salts of a metal belonging to Group II or III of the Periodic Table. Thus, use can be made of sulphonates, of, for instance, calcium, barium, magnesium, zinc or aluminium, either as monosulphonates or as disulphonates.

Moreover, such sulphonates, when made overbasic by the introduction of extra amounts of the metal (especially calcium), can constitute thickeners which are better than the corresponding neutral sulphonates.

The organic liquid which can be thickened is preferably a mineral oil; a polyglycol, for example a polyglycol polyoxyethylene or a polyglycol polyoxypropylene; a polyester, for example dioctyl sebacate; or a silicone, for example dimethylpolysiloxane.

The thickened organic liquids produced by the process of the present invention constitute another aspect of the present invention.

A further aspect of the present invention provides a lubricating grease of which from 60 to 95% by weight is a lubricating liquid and from 5 to 40% by weight is a sulphonate of a metal selected from alkaline earth metals, zinc and aluminium, the sulphonate being derived from at least one alpha-olefin.

Preferred features relating to the process of the present invention also apply, where appropriate, to the lubricating grease itself.

Much of the following description relates to lubricating greases because of their high commercial importance, but it is to be appreciated that the general techniques disclosed in relation to lubricating greases are applicable to the thickening of other organic liquids.

The use of metal sulphonates, mainly of alkali and alkaline earth metals, as additives and co-thickeners for lubricating greases, is known. Also, many rust inhibiting composition for lubricating greases contain alkaline earth metal sulphonates or alkyl sulphonates of alkaline earth metals. However, the use of sulphonates of various natures while improving some specific characteristics of the greases, for example the rust-inhibiting quality and the homogeneity, can impart other characteristics, for example, resistance to being washed away by water. In many cases there is even a strong tendency to become too thin.

However, the disadvantages associated with prior art lubricating greases are reduced or obviated by the lubricating greases of the present invention.

Further it has been observed that when the sulphonates employed in the lubricating grease of the present invention are made "overbasic" through the introduction of bigger quantities of metal, e.g. calcium as $CaCO_3$, the resulting sulphonates constitute thickeners which are better than the corresponding neutral sulphonates.

Various experiments were carried out in order to determine the optimum degree of overbasicity for the sulphonates to obtain a good thickening capability.

For practical purposes, when determining the optimum degree of overbasicity for obtaining the best thickening power, it is necessary to bear in mind that while from the point of view of technical characteristics a lower degree of overbasicity is generally more desirable, the products having a higher basicity are from an economical point of view, more attractive. Thus, on balance, the products having an intermediate degree of overbasicity are generally the most convenient.

By increasing the overbasicity some characteristics continue to be improved, for instance the dropping point, but other characteristics tend to become less satisfactory, e.g. the thickening possibility.

As regards the molecular weight of the alpha-olefins used to produce the sulphonates, it is generally the case that the lower cuts, e.g. ($C_{12}$–$C_{14}$), produce thickeners which are not always completely satisfactory from the point of preventing the lubricating liquid from escaping, whereas the cuts having higher molecular weights, e.g. ($C_{20}$–$C_{24}$), tend to produce a thickener which results in a grease having a lower consistency or penetration.

Regardless of whether or not any adjustment to the degree of overbasicity is required, the sulphonate can be heated in the presence of at least one volatile organic solvent and, before or after at least part of the lubricating fluid (or other organic liquid) is added, the solvent evaporated prior to the remainder of the material being subjected to a severe grinding in a colloid mill or in other suitable apparatus.

The greases which can be produced in accordance with the present invention generally have a high resistance to mechanical work, a higher resistance to loads and a high dropping point.

In the following Examples, which illustrate the present invention, an indication in one Example that a technique followed is similar to that in an earlier Example is to be taken as meaning that, apart from the difference(s) specified, the two Examples are identical quantitatively, qualitatively and in terms of the procedural steps.

The Examples also show that molecular fractions of $C_{15}$–$C_{18}$ alpha-olefins, and mixtures of fractions having a lower molecular weight and of fractions having a molecular weight higher than the range $C_{15}$–$C_{18}$, give equally satisfactory results.

EXAMPLE 1

200 Grams of the calcium monosulphonate of a $C_{15}$–$C_{18}$ alpha-olefin mixture were treated with 500 grams of toluene and heated under reflux for 30 minutes. 800 Grams of mineral oil were added to the refluxed mixture and then the solvent, toluene, was removed by evaporation.

The resulting product was ground in a colloid mill until it had the desired consistency.

The main characteristics of the product were as follows:

| | |
|---|---|
| initial penetration | = 250 dmm |
| penetration after 60 double strokes | = 255 dmm |
| penetration after 100,000 double strokes | = 295 dmm |
| dropping point ASTM | = 235° C. |

In these Examples the abbreviation "ASTM" means that the dropping point was calculated in accordance with ASTM D 566-6. The determination of penetration was carried out in accordance with ASTM D-217-68.

EXAMPLE 2

The technique followed here was similar to that of Example 1 except that instead of the calcium monosulphonates there were used the same weight of calcium disulphonates of the same $C_{15}$–$C_{18}$ alpha-olefin mixture.

The main characteristics of the product were as follows

| | |
|---|---|
| Initial penetration | = 270 dmm |
| penetration after 60 double strokes | = 275 dmm |
| penetration after 100,000 double strokes | ≠ 320 dmm |
| dropping point ASTM | = 220° C. |

EXAMPLE 3

20 grams of calcium oxide, in the form of a powder were treated with 300 ml of methanol, said mixture being vigorously stirred. Carbon dioxide was then added to the resulting mixture while an exothermic reaction took place with the subsequent formation of a gelatinous product.

Separately, 160 grams of calcium monosulphonate obtained from the monosulphonic acid of a $C_{15}$–$C_{18}$ alpha-olefin mixture were dispersed in 600 cc of toluene, and the whole was boiled under reflux for 30 minutes, after which it was cooled and then added to the vessel containing the treated calcium oxide.

The resulting mixture was homogenized, and carbon dioxide was bubbled into the mixture for 30 minutes.

At the end of this period, the evaporation of the solvents (methanol and toluene) was started, and 200 grams of mineral oil were added.

After the solvents had been removed, the product was milled in a colloid mill, with the slow addition of a further 600 grams of mineral oil. The finished grease appeared perfectly homogeneous with a short fibre and almost transparent. The main characteristics were as follows:

| | |
|---|---|
| initial penetration | = 265 dmm |
| penetration after 60 double strokes | = 265 dmm |
| penetration after 100,000 double strokes | = 300 dmm |
| dropping point ASTM | = 260° C. |

EXAMPLE 4

The technique followed here was similar to that of Example 1, the only difference being the replacement of 200 grams of the calcium alkyl monosulphate by 200 grams of the calcium alkylene disulphonate.

The main characteristics of the product were as follows:

| | |
|---|---|
| initial penetration | = 250 dmm |
| penetration after 60 double strokes | = 260 dmm |
| penetration after 100,000 double strokes | = 255 dmm |

EXAMPLE 5

The technique followed here was similar to that of Example 1, the only difference being the replacement of 800 grams of mineral oil by 800 grams of a silicone liquid having an Engler viscosity of 50° C. of about 8.

The main characteristics of the resulting grease were as follows:

| | |
|---|---|
| initial penetration | = 230 dmm |
| penetration after 60 double strokes | = 230 dmm |
| penetration after 100,000 double strokes | = 245 dmm |
| dropping point ASTM | = 250° C. |

EXAMPLE 6

The technique followed here was similar to that of Example 1, the only difference being the replacement of the mineral oil by the same weight of the silicone liquid described in Example 1, and the replacement of the calcium monosuplhonate of a $C_{15}$–$C_{18}$ alpha-olefin mixture by the same weight of the calcium disulphonate of the same alpha-olefin mixture.

The main characteristics of the grease were as follows:

| | |
|---|---|
| initial penetration | = 240 dmm |
| penetration after 60 double strokes | = 245 dmm |
| penetration after 100,000 double strokes | = 280 dmm |
| dropping point ASTM | = 260° C. |

EXAMPLE 7

The technique here was similar to that of Example 1, the only difference being that the mineral oil was replaced by the weight of a polyglycol having an Engler viscosity of about 6 at 50° C.

The main characteristics of the resulting grease were as follows:

| | |
|---|---|
| initial penetration | = 250 dmm |
| penetration after 60 double strokes | = 260 dmm |
| penetration after 100,000 double strokes | = 285 dmm |
| dropping point ASTM | = 258° C. |

EXAMPLE 8

The technique here was similar to that of Example 1, except that instead of the calcium monosulphonate there was used the calcium disulphonate from the $C_{15}$–$C_{18}$ alpha-olefin cut and except that there was used a polyglycol with an Engler viscosity at 50° C. of about 6 instead of the mineral oil.

The main characteristics of the resulting grease were as follows:

| | |
|---|---|
| initial penetration | = 250 dmm |
| penetration after 60 double strokes | = 250 dmm |
| penetration after 100,000 double strokes | = 285 dmm |
| dropping point ASTM | = 240° C. |

EXAMPLE 9

The technique here was similar to that of Example 1, the only difference being the replacement of the mineral oil by the same weight of a synthetic lubricating fluid based on adipates (which are esters).

The main characteristics of the resulting grease were as follows:

| | |
|---|---|
| initial penetration | = 200 dmm |
| penetration after 60 double strokes | = 200 dmm |
| penetration after 100,000 double strokes | = 230 dmm |
| dropping point ASTM | = 250 ° C. |

EXAMPLE 10

The technique here was similar to that of Example 1, the only difference being the replacement of the calcium monosulphonate from alpha-olefins the $C_{15}$–$C_{18}$ mixture by the same weight of the corresponding disulphonate, and replacement of the mineral oil by a synthetic lubricating fluid based on adipates.

The main characteristics of the grease were as follows:

| | |
|---|---|
| initial penetration | = 240 dmm |
| penetration after 60 double strokes | = 250 dmm |
| penetration after 100,000 double strokes | = 285 dmm |
| dropping point ASTM | = 245° C. |

EXAMPLE 11

80 grams of calcium oxide, in the form of a powder, were treated under vigorous stirring with 300 cc of methanol into which was bubbled $CO_2$. An exothermic reaction took place and a gelatinous product was formed.

Separately 40 grams of the calcium monosulphonate obtained from a $C_{15}$–$C_{18}$ alpha-olefin mixture were dispersed in 600 cc of toluene. The dispersion was boiled under reflux for 30 minutes, then it was allowed to cool and then the whole was added to the vessel containing the treated calcium oxide. The resulting mixture was homogenized and the bubbling of carbon dioxide was continued for 30 minutes. At the end of this period the evaporation of the solvents (methanol and toluene) was started, and 200 grams of mineral oil were added to the mixture.

After the solvents had been removed the product was milled six times in a colloid mill with the slow addition of a further 600 grams of mineral oil.

The resulting grease appeared to have a short fibre and to be almost transparent. The main characteristics were as follows:

| | |
|---|---|
| initial penetration | = 280 dmm |
| penetration after 60 double strokes | = 285 dmm |
| penetration after 100,000 double strokes | = 340 dmm |
| dropping point ASTM | > 250° C. |

EXAMPLE 12

The technique here was similar to that of Example 11, except that instead of the monosulphonates these were employed the same weight of calcium disulphonates.

The main characteristics of the grease were as follows:

| | |
|---|---|
| initial penetration | = 300 dmm |
| penetration after 60 double strokes | = 310 dmm |
| penetration after 100,000 double strokes | = 360 dmm |
| dropping point ASTM | > 250° C. |

EXAMPLE 13

The technique here was similar to that of Example 3, the only difference being quantitative and not qualitative. In fact, here there were employed 70 grams of calcium oxide, 60 grams of the calcium monosulphonate and 800 grams of the mineral oil.

The main characteristics of the resulting grease were as follows:

| | |
|---|---|
| initial penetration | = 270 dmm |
| penetration after 60 double strokes | = 275 dmm |
| penetration after 100,000 double strokes | = 295 dmm |
| dropping point ASTM | > 250° C. |

EXAMPLE 14

The technique here was similar to that of Example 13, the only difference being that there was used here the disulphonate instead of the monosulphonate.

The main characteristics of the resulting grease were as follows:

| | |
|---|---|
| initial penetration | = 290 dmm |
| penetration after 60 double strokes | = 295 dmm |
| penetration after 100,000 double strokes | = 350 dmm |
| dropping point ASTM | > 250° C. |

EXAMPLE 15

The technique followed here was similar to that of Example 13 except that instead of the mineral oil there was used the same weight of dimethyl polysiloxane. The main characteristics of the resulting grease were as follows:

| | |
|---|---|
| initial penetration | = 280 dmm |
| penetration after 60 double strokes | = 285 dmm |
| penetration after 100,000 double strokes | = 350 dmm |
| dropping point ASTM | > 250° C. |

EXAMPLE 16

The technique followed here was similar to that of Example 14, the only difference being that the mineral oil was replaced by phenyl methyl polysiloxane.

The main characteristics of the resulting grease were as follows:

| | |
|---|---|
| initial penetration | = 300 dmm |
| penetration after 60 double strokes | = 310 dmm |
| penetration after 100,000 double strokes | = 380 dmm |
| dropping point ASTM | > 250° C. |

EXAMPLE 17

The technique followed here was similar to that of Example 13, the only difference being that the mineral oil was replaced by the same weight of polyethylene glycol.

The main characteristics of the resulting grease were as follows:

| | |
|---|---|
| initial penetration | = 300 dmm |
| penetration after 60 double strokes | = 310 dmm |
| penetration after 100,000 double strokes | = 380 dmm |

-continued

| | |
|---|---|
| dropping point ASTM | > 250° C. |

EXAMPLE 18

The technique followed here was similar to that of Example 14, the only difference being the replacement of the mineral oil by the same weight of polyglycol polyoxyethylene.

The main characteristics of the resulting grease were as follows:

| | |
|---|---|
| initial penetration | = 280 dmm |
| penetration after 60 double strokes | = 320 dmm |
| penetration after 100,000 double strokes | = 390 dmm |
| dropping point ASTM | > 250° C. |

EXAMPLE 19

The technique followed here was similar to that of Example 13, the only difference being the replacement of the mineral oil by the same weight of dioctylsebacate.

The main characteristics of the resulting grease were as follows:

| | |
|---|---|
| initial penetration | = 280 dmm |
| penetration after 60 double strokes | = 320 dmm |
| penetration after 100,000 double strokes | = 395 dmm |
| dropping point ASTM | > 230° C. |

EXAMPLE 20

The technique followed here was similar to that of Example 14, the only difference being the replacement of the mineral oil by diisobutyladipate as lubricating fluid.

The main characteristics of the resulting grease were as follows:

| | |
|---|---|
| initial penetration | = 310 dmm |
| penetration after 60 double strokes | = 320 dmm |
| penetration after 100,000 double strokes | = 395 dmm |
| dropping point ASTM | > 200° C. |

EXAMPLE 21

120 grams of barium hydroxide octahydrate, $Ba(OH)_2.8H_2O$, if finely divided form were dispersed in 300 cc of anhydrous methyl alcohol. $CO_2$ was bubbled for 30 minutes into the resulting dispersion. A dispersion constituted by 80 grams of the barium monosulphonate derived from a $C_{14}$–$C_{18}$ alpha-olefin mixture, in 400 cubic centimeters of toluene, was added to the barium hydroxide dispersion $CO_2$ was bubbled through the mixture and the removal of the solvents (methanol and toluene) was started. 300 grams of napthenic mineral oil having an Engler viscosity at 50° C. of 8 were introduced under stirring. Stirring was continued, as was the evaporation of the remaining solvent. A homogeneous paste was obtained which was milled several times in a colloid mill, while gradually a further 300 grams of the naphthenic mineral oil were added.

The characteristics of the resulting grease were as follows:

| | |
|---|---|
| initial penetration | = 280 dmm |
| penetration after 60 double strokes | = 290 dmm |
| penetration after 100,000 double strokes | = 340 dmm |
| dropping point ASTM | > 250° C. |

EXAMPLE 22

200 grams of magnesium monosulphonate obtained from $C_{14}$–$C_{16}$ olefin mixture were treated with 500 ml of toluene. The resulting mixture was boiled under reflux for 30 minutes.

A dispersion of 30 grams of MgO in 200 ml of anhydrous methyl alcohol was added to the refluxed mixture, after the dispersion had been obtained through a vigorous stirring of the oxide sieved with a 200 mesh sieve. The resulting mixture was heated to boiling while $CO_2$ was bubbled through. After about an hour the evaporation of the solvents was commenced.

When about half of the solvents had been evaporated, 200 grams of naphthenic oil having an Engler viscosity of 8 at 50° C. were added and the balance of the solvents was evaporated. Upon completion of the evaporation of solvent, the product was milled in a colloid mill and a further 200 grams of naphthenic mineral oil were gradually added.

The resulting grease was translucent and had a consistence in the range from 290 to 300 dmm. The drop point was about 240° C.

The grease also possessed remarkable anti-rust characteristics.

EXAMPLE 23

200 grams of zinc disulphonate from a $C_{15}$–$C_{18}$ alpha-olefin mixture were treated with 300 ml of toluene while boiling under reflux, to obtain a very fine dispersion. A dispersion of ZnO in 200 ml of methyl alcohol, through which $CO_2$ had been bubbled for half an hour, was added to the refluxed material. Under vigorous stirring the resulting mixture was heated to boiling while $CO_2$ was bubbled through the mixture. After half of the solvent had been evaporated, 200 grams of mineral oil having an Engler viscosity at 50° C. of about 8 were added.

The heating was then continued with vigorous stirring, in order to evaporate all the solvent, after which a further 200 grams of the mineral oil were added and the resulting material was ground in a colloid mill in order to obtain a product of even consistency. A grease, light brown in colour was obtained which had strong anti-wear characteristics and a drop point of about 200° C.

EXAMPLE 24

100 grams of aluminum isopropoxide were reacted with 200 grams of the aluminum monosulphonate from a $C_{15}$–$C_{18}$ alpha-olefin mixture finely dispersed in 500 ml of toluene.

The resulting mixture was heated while $CO_2$ was bubbled through the mixture. When half of the solvent had been evaporated 250 grams of a mineral oil having an Engler viscosity at 50° C. of about 8 were added.

Under vigorous stirring the balance of the solvent was removed. The resulting paste was ground several times during which there was added a further 200 grams of the same oil.

The resulting grease had a consistence of 290 dmm, a good adhesive quality and a strong resistance to loads.

EXAMPLE 25

30 grams of CaO in finely powdered form were suspended in anhydrous methyl alcohol. $CO_2$ was bubbled through the resulting suspension for half an hour, with vigorous stirring. An exothermic reaction occurred, with the formation of a gelatinous product. To this product, with continuous stirring, was added a dispersion in 300 ml of toluene of 140 grams of calcium monosulphonate from a fraction of $C_{20}$–$C_{24}$ alpha-olefins. During the stirring, $CO_2$ was bubbled through the mixture. The mixture was heated and, after the solvent had been evaporated, there was obtained a homogeneous white powder eager for oil. Twenty parts by weight of this powder in a finely ground state, were mixed with 80 parts of a naphthenic mineral oil having an Engler viscosity at 50° C. of from 7 to 8, to produce a grease which had a fine consistency, which became semi-fluid if kept stirred and yet which had a thicker consistence if maintained still. This phenomenon occurred reversibly many times, and the grease might be of practical application in centralized plants.

EXAMPLE 26

120 grams of the calcium monosulphonate from $C_{12}$–$C_{14}$ alpha-olefin mixture were dispersed in 300 cc of toluene with heating under reflux.

40 grams of anhydrous calcium dioxide were dispersed in 300 cc of anhydrous methyl alcohol, and $CO_2$ was bubbled through the dispersion for half an hour.

The two dispersions were combined and more $CO_2$ was bubbled through the combined mixture, with heating. After the solvents had been removed the resulting powder was finely ground. The powder was ground in a weight ratio of 25% with a mineral oil having an Engler viscosity at 50° C. in the range from 7 to 8, to produce a grease having a consistence of 270 dmm and a drop point of 220° C.

EXAMPLE 27

80 grams of a calcium monosulphonate constituted by about 50% of the calcium monosulphonate of a $C_{12}$–$C_{14}$ alpha-olefin mixture and by about 50% of the calcium mono-sulphonate of a $C_{20}$–$C_{24}$ alpha-olefin mixture, were dispersed in 300 cc toluene with heating under reflux.

Separately 60 grams of CaO finely ground to a powder were dispersed in anhydrous methyl alcohol and $CO_2$ was bubbled through the dispersion for half an hour, with vigorous stirring.

These two dispersions were mixed, and more $CO_2$ was bubbled through the mixture with heating. After the solvents had been removed, the resulting powder was finely ground. The 25 parts by weight of this powder were ground with 75 parts of a mineral oil having an Engler viscosity at 50° C. in the range from 7 to 8, to give a grease having the following characteristics:

| | |
|---|---|
| initial penetration | = 300 dmm |
| penetration after 60 double strokes | = 305 dmm |

-continued

| | |
|---|---|
| penetration after 100,000 double strokes | = 350 dmm |
| dropping point ASTM | = 220° C. |

EXAMPLE 28

The following basic mixture, expressed as a percentage by weight, was homogenized.

| | |
|---|---|
| Zinc white (zinc oxide) | 5 |
| Zinc yellow (zinc chromate) | 11 |
| red lead | 38 |
| red iron oxides | 0.61 |
| Asbestos | 5.3 |
| Glycerophthalic resin "Long Oil" (containing 60% of non-volatile matter) | 27 |
| Pulp (25% of overbasic sulphonate in mineral resin) | 2 |
| Drying Agents | 1.72 |
| Mineral resin | 9.37 |

After 10 days, no deposit was observed in this composition which is suitable in the paint field. Other tests were carried out using the same components but at different percentages; the mixtures were compared with a mixture containing no sulphonate. Thus it was possible to note that the mixture without any sulphonate, after the same time, had a remarkable amount of deposit while even 0.5% of sulphonate reduced the amount of deposit to one fifth.

What we claim is:

1. A lubricating grease of which 60 to 95% by weight is a lubricating liquid and from 5 to 40% by weight is an overbasic alkylene sulfonate of a metal selected from the group consisting of alkaline earth metals, zinc and aluminum, said sulfonate being derived from alpha-olefins having between 12 and 24 carbon atoms and being rendered overbasic by the corresponding metal carbonate.

2. A lubricating grease as defined in claim 1 wherein the alkaline earth metal is calcium.

3. A lubricating grease of which 60 to 95% by weight is a lubricating liquid and from 5 to 40% by weight is an overbasic alkylene sulfonate of calcium and an alpha olefin having between 12 and 24 carbon atoms and being rendered overbasic by calcium carbonate.

4. A lubricating grease of which 60 to 95% by weight is a lubricating liquid and from 5 to 40% by weight is an overbasic alkylene sulfonate of barium and an alpha olefin of between 12 and 24 carbon atoms and being rendered overbasic by barium carbonate.

5. A lubricating grease of which 60 to 95% by weight is a lubricating liquid and from 5 to 40% by weight is an overbasic alkylene sulfonate of magnesium and an alpha olefin of between 12 and 24 carbon atoms and being rendered overbasic by magnesium carbonate.

6. A lubricating grease of which 60 to 95% by weight is a lubricating liquid and from 5 to 40 % by weight is an overbasic alkylene sulfonate of zinc and an alpha olefin of between 12 and 24 carbon atoms and being rendered overbasic by zinc carbonate.

* * * * *